United States Patent [19]

Burgoon et al.

[11] 4,369,540

[45] Jan. 25, 1983

[54] FLOOR CLEANING MACHINE

[75] Inventors: Jack L. Burgoon; David J. Karpanty, both of Toledo, Ohio

[73] Assignee: The Scott & Fetzer Company, Lakewood, Ohio

[21] Appl. No.: 248,298

[22] Filed: Mar. 27, 1981

[51] Int. Cl.[3] ..... A47L 11/24; A47L 11/30

[52] U.S. Cl. ..... 15/49 R; 15/50 R; 15/50 C; 15/340

[58] Field of Search ..... 15/83-86, 15/340, 79 A, 320, 50 R, 50 C, 49 R, 49 C

[56] References Cited

U.S. PATENT DOCUMENTS

| | | | |
|---|---|---|---|
| 2,631,314 | 3/1953 | Fitzpatrick | 15/83 |
| 3,942,218 | 3/1976 | Krier et al. | 15/50 C |
| 4,041,567 | 8/1977 | Burgoon | 15/83 X |

FOREIGN PATENT DOCUMENTS

| | | | |
|---|---|---|---|
| 1521035 | 8/1978 | United Kingdom | 15/83 |

*Primary Examiner*—Edward L. Roberts

*Attorney, Agent, or Firm*—Allen D. Gutchess, Jr.

[57] ABSTRACT

A machine for cleaning floors is provided and more particularly a riding machine which both sweeps and scrubs the floors. The machine has a rotary drum broom near the front and three staggered disc brushes at an intermediate portion. The drum broom is rotatably carried by two arms which are pivotally mounted on a frame or body of the machine. A hopper for receiving dirt and debris from the drum broom is also moveably mounted on the arms in front of the broom. A linkage and lever mechanism is used to rotate the arms to raise and lower the broom and the hopper simultaneously when the cleaning machine is driven from one location to another. A squeegee assembly is carried by the machine behind the disc brushes for picking up the dirty solution, clean solution being first supplied to the disc brushes and to the floor. A tank for supplying clean solution and a tank for receiving dirty solution from the floor are also located on the machine above the rotary drum broom and at least one of the tanks is tiltable to the side for access to components of the machine located therebelow.

26 Claims, 8 Drawing Figures

FLOOR CLEANING MACHINE

This invention relates to a machine for cleaning floors and specifically for sweeping and scrubbing floors.

A machine according to the invention both sweeps and scrubs floors being cleaned and yet the machine is of a relatively uncomplicated and compact design. The machine preferably is of the riding type and has a rotary drum broom near the front thereof for sweeping dirt and debris and a plurality of staggered disc brushes behind the drum broom for scrubbing the floor. A squeegee assembly is located behind the disc brushes to pick up dirty solution from the floor, the clean solution being supplied to the disc brushes and the floor; a small hopper is located in front of the rotary drum broom to receive dirt and debris therefrom. The drum broom is mounted on a shaft, the ends of which are rotatably carried by two arms which, in turn, are pivotally supported by a frame or body of the machine. A drive motor is mounted on one of the arms and is connected to the shaft to rotate the broom. The hopper is designed to be engagable with and carried by the arms and can be inserted over forward ends of the arms and removed therefrom when it is emptied. A lift shaft rotatably carried by the frame has end portions affixed to the arms. A lever and linkage arrangement is connected to the lift shaft to turn it and thereby raise and lower both the drum broom and the hopper, with both being raised when the machine is to be driven from one cleaning location to another.

It is, therefore, a principal object of the invention to provide a relatively compact and uncomplicated floor cleaning machine of the riding type.

Another object of the invention is to provide a compact machine for cleaning floors which both sweeps and scrubs the floors.

A further object of the invention is to provide a floor cleaning machine having a rotary drum broom at a forward portion thereof, a plurality of disc brushes at an intermediate portion thereof, a rear squeegee assembly, and a front hopper for receiving dirt and debris from the drum broom.

Yet another object of the invention is to provide a floor cleaning machine having a rotary broom and a hopper with means for raising and lowering the broom and the hopper substantially simultaneously.

Yet a further object of the invention is to provide a floor cleaning machine having a rotary drum broom and a hopper mounted on common arms which are pivotally carried by the machine.

Still another object of the invention is to provide a floor cleaning machine having a recovery tank which can be tilted to the side of the machine for access to components of the machine located below the tank.

Many other objects and advantages of the invention will be apparent from the following detailed description of a preferred embodiment thereof, reference being made to the accompanying drawings, in which.

Figure 1:
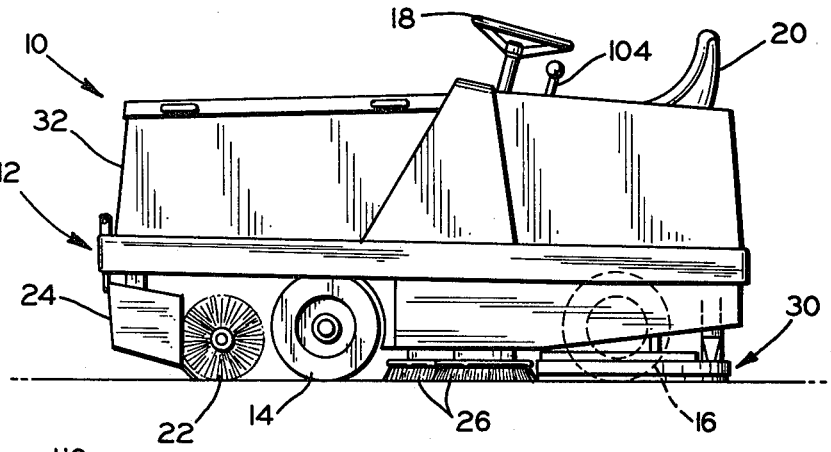
FIG. 1 is a somewhat schematic side view in elevation of a floor cleaning machine embodying the invention.

Referring to FIG. 1, a floor cleaning machine embodying the invention is indicated at 10. The machine shown cleans the floor by a combined scrubbing and sweeping action. The machine includes a body or frame 12 with forward wheels 14 and a rear wheel 16 which steers the machine through a steering wheel 18 located in front of an operator's seat 20.

A rotary drum broom 22 is located at a forward portion of the machine and sweeps dirt and debris from the floor being cleaned into a front hopper 24. Three rotary disc brushes 26 are located behind the wheels 14 and behind the drum broom 22, being located in a staggered relationship so that the paths covered by the brushes slightly overlap. The path of the drum broom 22 and the combined path of the disc brushes 26 extend substantially over the width of the machine 10 and are substantially coextensive.

Figure 2:
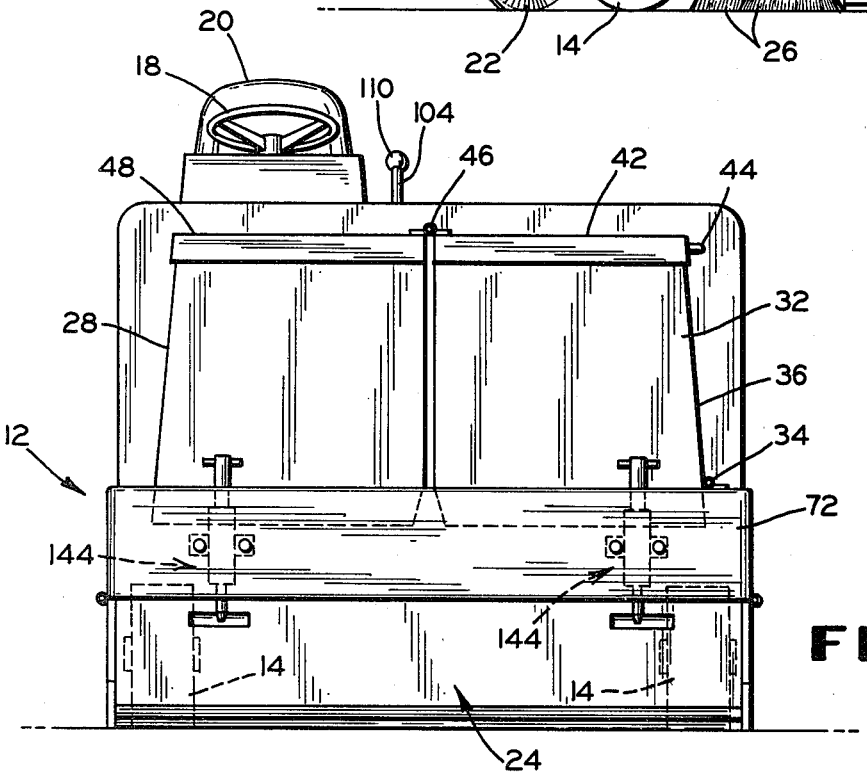
FIG. 2 is a somewhat schematic front view in elevation of the floor cleaning machine.
Figure 3:
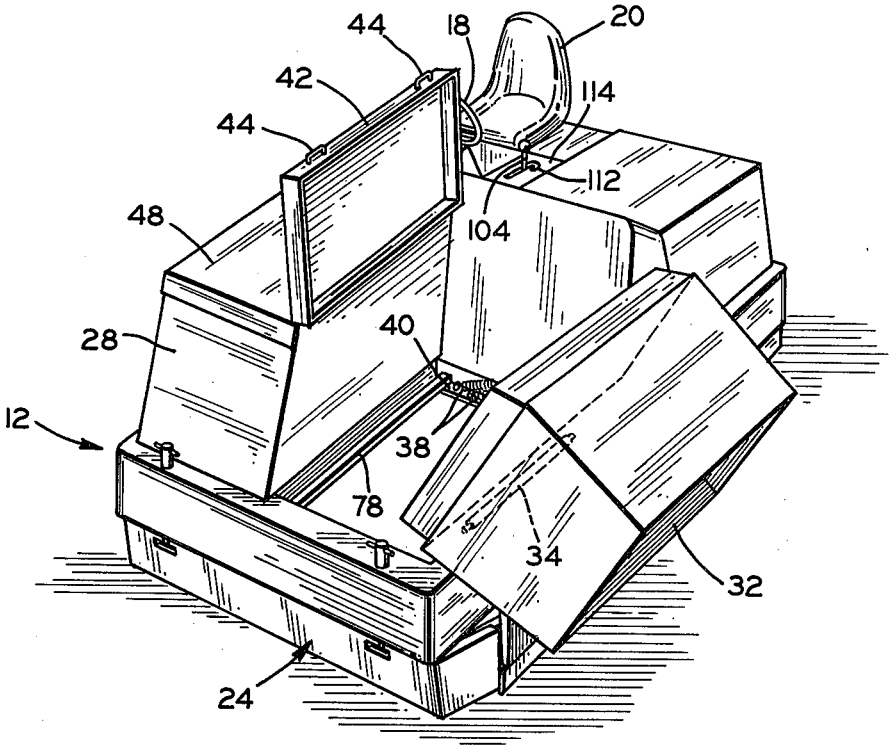
FIG. 3 is a view in perspective of the floor cleaning machine, showing a recovery tank tilted to the side.

Cleaning solution is supplied from a first supply tank 28 (FIGS. 2 and 3) which is located at a forward portion of the machine. The solution can be supplied directly to the floor being cleaned or to the disc brushes 26 and onto the floor. A substantial portion of the solution deposited on the floor is then picked up by a rear squeegee assembly 30. The dirty solution is drawn by vacuum to a second, receiving tank 32 which is also located at the forward portion of the machine 10 in side-by-side relationship with the tank 28. At least one of the tanks 28 and 32 is tiltable to provide access to components of the machine located therebelow. As shown, the tank 32 has a long hinge 34 which is affixed to a lower portion of a side wall 36 of the tank 32 and to an upper surface of the frame 12. Two or more springs 38 (FIG. 3) are suitably affixed to a strut 40 of the machine and to a rear end portion of the tank 32 to provide a counterbalancing effect when the tank is tilted. As shown, a lid 42 of the tank 32 has outer handles 44 and a hinge 46 at the inner edge which can be connected to an adjacent edge of a lid or top 48 on the tank 28. In the tilted position, the tank 32 not only provides access to components of the machine located under the tanks but also the tank can be cleaned more readily in this position.

Figure 4:
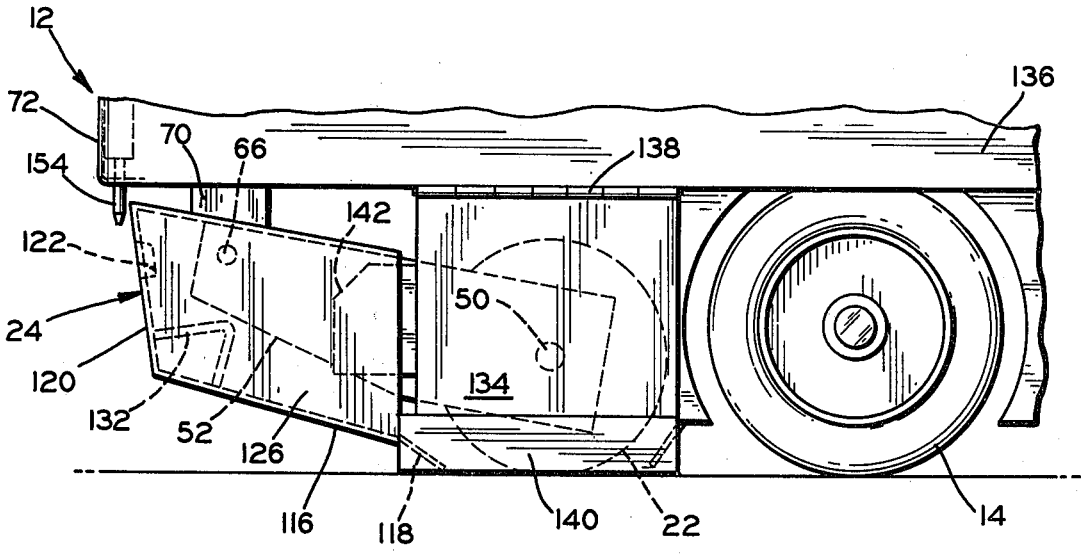
FIG. 4 is an enlarged, fragmentary view of a forward portion of the floor cleaning machine showing a rotary drum broom and a hopper.
Figure 5:
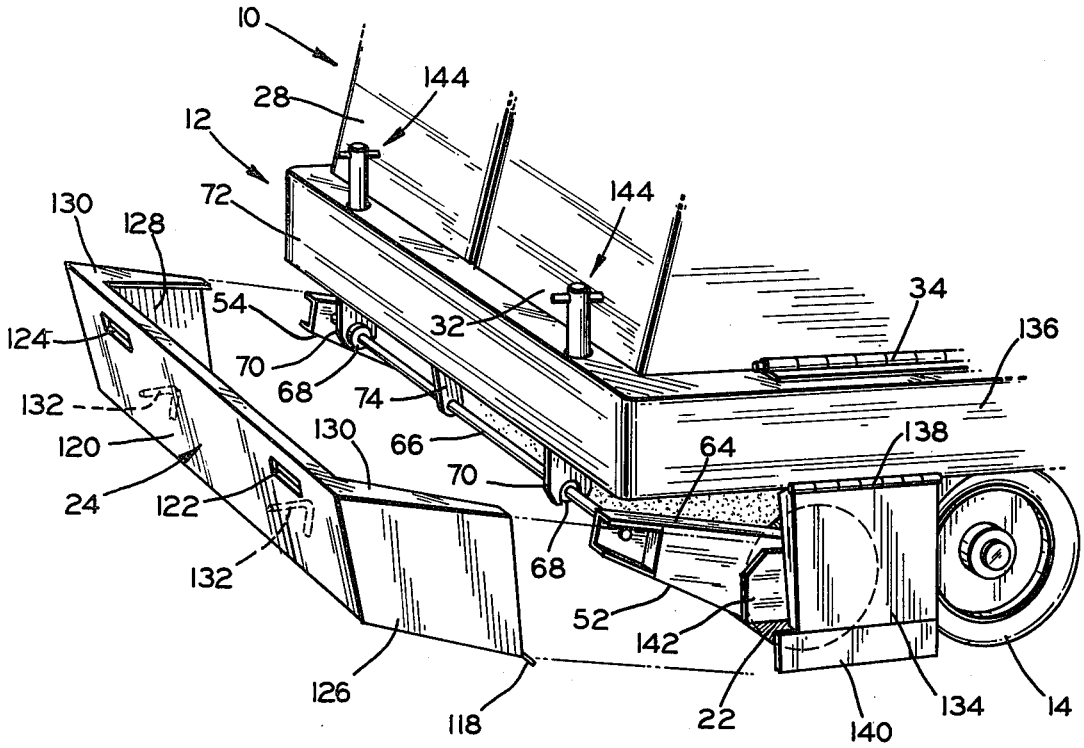
FIG. 5 is a view in perspective of the forward portion of the machine showing the hopper in a removed position.

The rotary drum broom 22 can be of any suitable construction known in the art. It has a shaft 50 extending therethrough, the ends of which are rotatably held by arms 52 and 54 (FIGS. 4 and 5). The shaft 50 has a driven sprocket 56 (FIG. 6) affixed thereto and engagable with a drive chain 58. The chain is engaged with a drive sprocket 60 driven by a motor 62 which is mounted on the arm 52. The motor can be hydraulically driven as can be the disc brushes 26 by small hydraulic motors powered by fluid under pressure, if the machine 10 has that type of system. Otherwise, an electric motor or other suitably energized motors can be used to rotate the drum broom 22. By mounting the motor 62 on the arm 52, the spacing between the drive and the driven sprockets 60 and 56 can be maintained constant even when the broom 22 is raised or lowered. The drum broom 22 is rotated in a clockwise direction by the motor, as viewed in FIGS. 4–6.

The arms 52 and 54 have outwardly-extending stiffening flanges 64 along upper and lower edges thereof. The ends opposite the ends rotatably holding the broom shaft 50 are reinforced and are affixed to end portions of a lift shaft 66. The lift shaft 66 has spaced bearings 68 which are held in brackets 70 depending from the machine frame 12. Thus, the shaft 66, the bearings 68, and the brackets 70 pivotally support the arms 52 and 54 from the frame 12, and specifically from a front frame member 72 thereof.

The arms 52 and 54 are raised and lowered to raise and lower the drum broom 22. The broom is raised when the machine is to be transported from one cleaning location to another or between a storage location and a cleaning location, by way of example. When the broom 22 is in a lower, sweeping position, it preferably floats relative to the floor to make up for variations in the level thereof. To raise and lower the broom 22 and the arms 52 and 54, the lift shaft 66 is turned. To accomplish this, an intermediate portion of the shaft has an end of a lift arm 74 (FIG. 6) affixed thereto and another end extending upwardly therefrom. The upper end of the arm 74 is pivotally connected by a pin 76 to a long link 78 extending rearwardly to a position near the driver's seat. The rearward end of the link 78 has an elongate slot 80 receiving a pin 82 extending from an upper end of a generally L-shaped link 84. This link has an intermediate portion pivotally supported by a pin 86 and a fixed member 88 of the machine frame 12. The rear end portion of the link 84 is pivoted by a pin 90 to an adjusting rod 92. The effective length of the adjusting rod 92 can be changed to compensate for wear of the bristles of the drum broom 22. For this purpose, the rod 92 has a threaded end 94 extending through a cylindrical body 96 and is threaded in a tubular handle 97 which can be turned from the operator's seat 20 to change the length of the rod 92 between the pin 90 and the body 96. The body 96 extends outwardly from a bar 98 which is affixed to a stub shaft 100, with the shaft 100 being rotatably carried by a supporting bracket 102 of the machine. An operating lever 104 extends upwardly from the stub shaft 100, having a clevis 106 at the lower end pivotably connected to the shaft 100 by a pin 108. The operating lever 104 can pivot from side to side to some degree but rotates the stub shaft 100 when the lever is moved forward and back relative to the cleaning machine. The upper end of the lever 104 has a knob or handle 110 above a J-shaped slot 112 in a panel 114 (FIG. 3) through which the lever extends.

Figure 6:
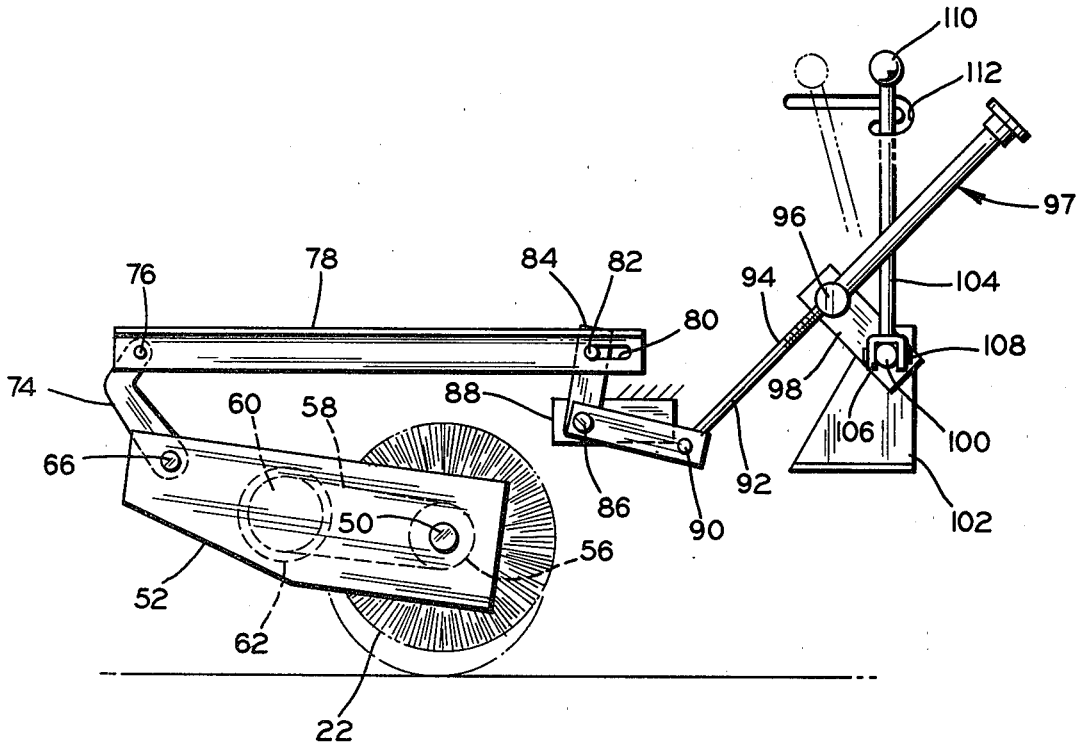
FIG. 6 is a schematic side view in elevation showing a lift shaft and mechanism for turning the lift shaft to rotate arms on which the broom and hopper are mounted.

When the lever 104 is moved from the dotted line position to the solid line position in FIG. 6, it turns the stub shaft 100 in a clockwise direction and moves the bar 98 in the same direction along with the adjusting rod 92. The L-shaped link 84 is thereby moved in a counterclockwise direction to move the link 78 forwardly when the pin 82 hits the end of the slot 80 and the movement of the L-shaped link continues. This causes the lift arm 74 to move in a counterclockwise direction and accordingly moves the lift shaft 66. This causes the arms 52 and 54 to move counterclockwise and thereby raise the broom 22. The broom is then held in the raised position with the lever 104 being held rearwardly at the short end of the J-shaped slot 112. When the lever 104 is moved back toward the dotted line position, the linkages are accordingly moved in the opposite direction until the broom 22 engages the floor. The pin 82 can move back and forth in the slot 80 to enable the broom 22 to float on the floor. The lever 104 can also move back and forth in the slot 112 as the broom floats. The weight of the broom can be partially off set by suitable springs or other components connected to the arms 52 and 54, if desired, as is known in the art.

In accordance with the invention, the hopper 24 is also carried by the arms 52 and 54 and is raised and lowered with the drum broom 22. The hopper 24 has a bottom wall 116 slanting downwardly in a rearward direction and terminating with a flexible flap 118. The hopper also has a front wall 120 with hand recesses 122 and 124 to facilitate removal of the hopper off the arms 52 and 54. End walls 126 and 128 of the hopper have inwardly-extending flanges 130 at the upper edges which extend over and engage the end flanges 64 of the arms. The hopper 24 is thereby supported by the arms but can be raised relative to the arms if a larger object should be encountered on the floor being cleaned. The object can thereby pass under the hopper without jamming. The hopper also has two generally inverted L-shaped handles 132 formed therein and extending between the bottom wall 116 and the front wall 120. The operator can pull the hopper 24 off or nearly off the arms 52 and 54 when the hopper is to be emptied and then grasp the handles 132 to further carry the hopper. By employing common arms and mechanism to both raise and lower the drum broom 22 and the hopper 24, considerable costs are saved and a constant relationship is maintained between the hopper and the broom even when the broom floats relative to the surface being cleaned.

An access door 134 is located at one end of the broom 22, being hinged to a side frame member 136 of the frame 12 by a hinge 138 at an upper edge and having a flexible flap 140 at its lower edge. The access door has a forwardly extending tab 142 over which extends the hopper end wall 126 when in its operating position. This keeps the access door 134 from being opened when the machine is operating, and prevents the hopper from dragging on the floor if the broom 22 wears excessively.

Figure 7:
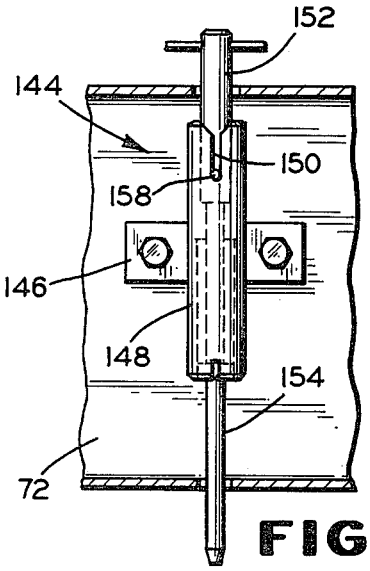
FIG. 7 is an elevational view of a hopper lock in one position.
Figure 8:
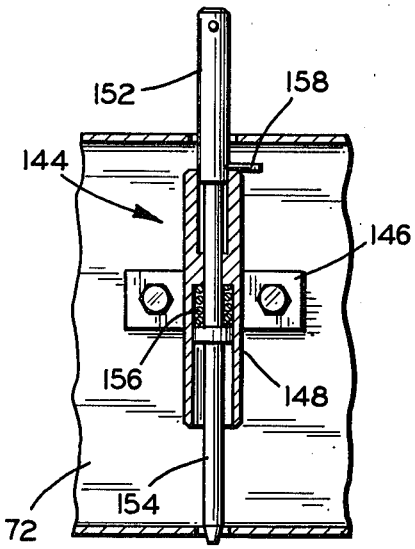
FIG. 8 is a view in vertical section through the hopper lock in another position.

If desired, hopper locks 144 (FIGS. 2, 4, 7 and 8) can be mounted on the inner surface of the front frame member 72. The lock is shown in a locking position in FIG. 7, and in a retracted position in FIG. 8. In the locking position, the locks prevent an empty hopper, when in the raised position, from vibrating off the machine during transit. They also prevent the hopper from being impacted off the machine by large debris thrown into it and from being dragged off the machine when it is backing down a ramp. As shown in FIGS. 7 and 8, each of the hopper locks includes a mounting flange 146 fastened to the front frame member 72 and to which is attached a tubular housing 148 having an upper slot 150. A handle 152 has a depending locking pin 154 and is urged downwardly by a spring 156. In the locking position of FIG. 7, the pin 154 extends below the frame member 72 and in front of the hopper 24. When the handle 152 is in the upper position of FIG. 8, it is turned 90 degrees so that a retaining pin 158 moves out of the slot 150 and holds the pin 154 in the retracted, position by resting on the upper edge of the tubular housing 148. In this position, the hopper can be readily removed and replaced.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A floor cleaning machine comprising a frame, a rotary broom having a shaft, a first arm having an end portion rotatably carrying a first end of said shaft, a second arm having an end portion rotatably carrying a second end of said shaft, a drive motor carried by said second arm and connected to said shaft near said second end to turn said shaft and said broom, a hopper removably mounted on said arms, a lift shaft having end portions affixed to the other end portions of said arms, means rotatably supporting said lift shaft from said frame, and means for turning said lift shaft to rotate said arms and to raise and lower said broom and said hopper.

2. A floor cleaning machine according to claim 1 characterized by said hopper comprising wall means forming a bottom, front, and end walls, and means extending inwardly from said end walls and engagable with said arms to mount said hopper on said arms.

3. A floor cleaning machine according to claim 2 characterized by said last-named means comprising flanges extending inwardly from upper portions of said end walls and engaging upper edge portions of said arms.

4. A floor cleaning machine according to claim 1 characterized by an access door pivotally carried by said frame and covering an end portion of said rotary broom and the end portion of the corresponding arm, said access door having means engagable with said hopper when said hopper is mounted on said arms to prevent said access door from being opened.

5. A floor cleaning machine according to claim 1 characterized by said turning means for said lift shaft comprising a remotely-located lever adjacent an operator's seat of said machine, and linkage means connecting said lever and said lift shaft.

6. A floor cleaning machine according to claim 5 characterized by said linkage means having slot means to enable said rotary broom to float relative to a floor being cleaned when said broom is in a lower position.

7. A floor cleaning machine comprising a frame, wheel means supporting said frame above the floor to be cleaned, a rotary drum broom extending transversely of said machine at a forward portion thereof, a plurality of disc brushes disposed across the machine behind said rotary drum broom, a squeegee behind said disc brushes, a hopper at a forward portion of said machine in front of said rotary drum broom for receiving dirt and debris from said rotary drum broom, said hopper being removable from the front of said machine, and means for raising and lowering said rotary drum broom and said hopper substantially simultaneously as a unit and independently of said plurality of of disc brushes.

8. A floor cleaning machine according to claim 7 characterized by said raising and lowering means comprising arms carrying said drum broom and said hopper, and means for rotating said arms.

9. A floor cleaning machine according to claim 8 characterized by said means for rotating said arms comprising a lift shaft having end portions affixed to said arms at portions spaced from said drum broom, means rotatably supporting said lift shaft from said frame, and means for turning said lift shaft to rotate said arms.

10. A floor cleaning machine according to claim 7 characterized by said raising and lowering means comprising arms rotatably carrying said drum broom and moveably supported by said frame, and said hopper being engagable with said arms.

11. A floor cleaning machine according to claim 10 characterized by said hopper having end walls which have means extending transversely therefrom and engagable with said arms.

12. A floor cleaning machine comprising a frame, a rotary room having a shaft, a first arm supported by said frame and rotatably carrying a first end of said shaft, a second arm supported by said frame and rotatably carrying a second end of said shaft, a hopper having end walls outside said arms and having means extending inwardly and engagable with said arms to removably mount said hopper on said arms, and means for rotating said arms to raise and lower said broom and said hopper.

13. A floor cleaning machine comprising a frame, a rotary broom having a shaft, a first arm supported by said frame and rotatably carrying a first end of said shaft, a second arm supported by said frame and rotatably carrying a second end of said shaft, a hopper having end walls with means engagable with said arms to enable said hopper to be removably mounted on said arms, and means for rotating said arms to raise and lower said broom and said hopper, said arms extending forwardly from said rotary broom, and said hopper fitting over the forward ends of said arms with the end walls being outside said arms, with said end walls having means extending inwardly and engagable with said arms to removably mount said hopper on said arms.

14. A floor cleaning machine according to claim 13 characterized by said inwardly-extending means comprising flanges along upper edges of said end walls of said hopper and engagable with upper edge portions of said arms to enable said hopper to be removed from the forward end of said machine and off the forward ends of said arms.

15. A floor cleaning machine according to claim 14 characterized by said hopper having a front wall extending between said end walls, and handle means on said front wall to facilitate removal of said hopper from said arms.

16. A floor cleaning machine comprising a frame, a rotary broom having a shaft, a first arm supported by said frame and rotatably carrying a first end of said shaft, a second arm supported by said frame and rotatably carrying a second end of said shaft, a hopper having end walls with means engagable with said arms to enable said hopper to be removably mounted on said arms, and means for rotating said arms to raise and lower said broom and said hopper, said means for rotating said arms comprising a lift shaft having end portions affixed to said arms at portions spaced from said broom shaft, means rotatably supporting said lift shaft from said frame, and means for turning said lift shaft to rotate said arms.

17. A floor cleaning machine according to claim 16 characterized by said turning means comprising a remotely located lever, and linkage means connecting said lever and said lift shaft for turning said lift shaft.

18. A floor cleaning machine according to claim 17 characterized by said linkage means comprising a lift arm having one end affixed to an intermediate portion of said lift shaft between said arms, and links pivotally connecting said lever and a portion of said lift arm spaced from said one end.

19. A floor cleaning machine according to claim 18 characterized by said links comprising a slotted connection to enable said broom to float relative to the floor being cleaned when in a lower position.

20. A floor cleaning machine according to claim 18 characterized by said links comprising an adjustable threaded connection accessible from an operator's seat of the machine for adjusting at least one of said links to compensate for broom wear.

21. A floor cleaning machine comprising a frame, wheel means supporting said frame above the floor to be cleaned, a rotary drum broom extending transversely of said machine at a forward portion thereof, a plurality of disc brushes disposed across the machine behind said rotary drum broom, a squeegee behind said disc brushes, a hopper in front of said rotary drum broom for receiving dirt and debris from said rotary drum broom, arms carrying said drum broom and said hopper, and means for rotating said arms for raising and lowering said rotary drum broom and said hopper substantially simultaneously, said means for rotating said arms comprising a lift shaft having end portions affixed to said arms at portions spaced from said drum broom, means rotatably supporting said lift shaft from said frame, and means for turning said lift shaft to rotate said arms.

22. A floor cleaning machine according to claim 21 characterized by said turning means comprising a remotely located lever, and linkage means connecting said lever and said lift shaft for turning said lift shaft.

23. A floor cleaning machine according to claim 22 characterized by said linkage means comprising a lift arm having one end affixed to an intermediate portion of said lift shaft between said arms, and links pivotally connecting said lever and a portion of said lift arm spaced from said one end.

24. A floor cleaning machine according to claim 23 characterized by said links comprising a slotted connection to enable said broom to float relative to the floor being cleaned when in a lower position.

25. A floor cleaning machine comprising a frame, wheel means supporting said frame above the floor to be cleaned, a rotary drum broom extending transversely of said machine at a forward portion thereof, a plurality of disc brushes disposed across the machine behind said rotary drum broom, a squeegee behind said disc brushes, a hopper at a forward portion of said machine for receiving dirt and debris from said rotary drum broom, said hopper being removable from the front of said machine, locking means carried by said machine and having one position in which the hopper can be removed from the machine and another position extending in front of the hopper in which the hopper cannot be removed from the machine, and means for raising and lowering said rotary drum broom and said hopper.

26. A floor cleaning machine comprising a frame, wheel means supporting said frame above the floor to be cleaned, a rotary drum broom extending transversely of said machine at a forward portion thereof, a plurality of disc brushes disposed across the machine behind said rotary drum broom, a squeegee behind said disc brushes, a hopper at a forward portion of said machine in front of said rotary drum broom for receiving dirt and debris from said rotary drum broom, said hopper being removable from said machine, a front frame member positioned above a front portion of said hopper, locking means carried by said frame member and having one position extending downwardly in front of said hopper for preventing removal of same, and a retracted position, and means for raising and lowering said rotary drum broom and said hopper.

* * * * *